US009821446B2

(12) United States Patent
Chai et al.

(10) Patent No.: US 9,821,446 B2
(45) Date of Patent: Nov. 21, 2017

(54) HANDHELD POWER TOOL HAVING A DRIVE MOTOR OPERABLE VIA A MANUAL SWITCH

(71) Applicant: Robert Bosch GmbH, Stuttgart (DE)

(72) Inventors: Jack Chai, Penang (MY); Chuan Cheong Yew, Penang (MY); Chun Chee Loh, Penang (MY); Sim Teik Yeoh, Penang (MY)

(73) Assignee: ROBERT BOSCH GMBH, Stuttgart (DE)

( * ) Notice: Subject to any disclaimer, the term of this patent is extended or adjusted under 35 U.S.C. 154(b) by 836 days.

(21) Appl. No.: 13/694,201

(22) Filed: Nov. 5, 2012

(65) Prior Publication Data

US 2013/0112446 A1 May 9, 2013

(30) Foreign Application Priority Data

Nov. 4, 2011 (DE) ..... 10 2011 085 765

(51) Int. Cl.
*B25D 16/00* (2006.01)
*B25B 21/02* (2006.01)
(Continued)

(52) U.S. Cl.
CPC ..... *B25D 16/006* (2013.01); *B25B 21/026* (2013.01); *B25D 11/08* (2013.01);
(Continued)

(58) Field of Classification Search
None
See application file for complete search history.

(56) References Cited

U.S. PATENT DOCUMENTS 4,085,337 A * 4/1978 Moeller ..... B21J 15/048 173/205
4,204,580 A * 5/1980 Nalley ..... B25D 16/00 173/170

(Continued)

FOREIGN PATENT DOCUMENTS

CN 1824465 8/2006
CN 101663134 3/2010

(Continued)

*Primary Examiner* — Hemant M Desai
*Assistant Examiner* — Mobeen Ahmed
(74) *Attorney, Agent, or Firm* — Norton Rose Fulbright US LLP; Gerrard Messina

(57) ABSTRACT

In a handheld power tool having a drive motor operable via a manual switch for driving a drive body which is associated with a mechanical percussion mechanism and coupled to a percussion member for driving an output shaft provided with a tool receptacle, and an operating mode switchover element which is designed to switch over between a normal operation and a percussion operation of the percussion mechanism and which is coupled to the drive body being associated with the drive body, an operating device is provided for operating the operating mode switchover element which is coupled to the manual switch and which is designed to enable a switchover of the operating mode switchover element between normal operation and the percussion operation of the percussion mechanism by operating the manual switch.

13 Claims, 5 Drawing Sheets

(51) Int. Cl.
*B25D 11/08* (2006.01)
*B25F 5/00* (2006.01)

(52) U.S. Cl.
CPC ..... *B25D 2216/0023* (2013.01); *B25D 2250/255* (2013.01); *B25D 2250/265* (2013.01); *B25F 5/001* (2013.01)

(56) References Cited

U.S. PATENT DOCUMENTS

| | | | | |
|---|---|---|---|---|
| 4,689,534 | A * | 8/1987 | Gerber | H01H 9/06 310/47 |
| 7,308,948 | B2 | 12/2007 | Furuta | |
| 7,320,368 | B2 * | 1/2008 | Watanabe | B25D 16/006 173/170 |
| 7,673,702 | B2 | 3/2010 | Johnson et al. | |
| 2003/0173178 | A1 | 9/2003 | Sasaki | |
| 2008/0245542 | A1 * | 10/2008 | Furusawa et al. | 173/201 |
| 2009/0145618 | A1 * | 6/2009 | Duesselberg et al. | 173/48 |
| 2009/0159304 | A1 * | 6/2009 | Teranishi et al. | 173/48 |
| 2010/0051303 | A1 * | 3/2010 | Ullrich et al. | 173/48 |
| 2010/0193206 | A1 * | 8/2010 | Teng | 173/48 |
| 2010/0206591 | A1 | 8/2010 | Schroeder et al. | |
| 2010/0326686 | A1 * | 12/2010 | Leong et al. | 173/48 |
| 2011/0048750 | A1 * | 3/2011 | Leong et al. | 173/47 |

FOREIGN PATENT DOCUMENTS

| | | | | |
|---|---|---|---|---|
| CN | 102001075 | | 4/2011 | |
| EP | 1607189 | | 12/2005 | |
| EP | 1607189 | A2 | 12/2005 | |
| EP | 1884318 | | 2/2008 | |
| EP | 1884318 | A2 | 2/2008 | |
| EP | 2168724 | | 3/2010 | |
| EP | 2168724 | A1 | 3/2010 | |
| FR | 2542368 | | 9/1984 | |
| FR | 2542368 | A1 | 9/1984 | |
| JP | WO 2011046029 | A1 * | 4/2011 | B25B 21/00 |
| WO | WO 2008/101556 | | 8/2008 | |
| WO | 2011046029 | A1 | 4/2011 | |

* cited by examiner

HANDHELD POWER TOOL HAVING A DRIVE MOTOR OPERABLE VIA A MANUAL SWITCH

CROSS REFERENCE TO RELATED APPLICATIONS

The present application claims priority to Application No. DE 10 2011 085 765.6, filed in the Federal Republic of Germany on Nov. 4, 2011, which is incorporated herein in its entirety by reference thereto.

FIELD OF INVENTION

The present invention relates to a handheld power tool having a drive motor operable via a manual switch for driving a drive body which is associated with a mechanical percussion mechanism and coupled to a percussion member for driving an output shaft provided with a tool receptacle, an operating mode switchover element, which is designed to switch over between a normal operation and a percussion operation of the percussion mechanism, being associated with the drive body, and which is coupled to the drive body.

BACKGROUND INFORMATION

Such a handheld power tool having a tool housing in which a mechanical percussion mechanism provided with a percussion member is situated is described in International Patent Publication No. WO 2008/101556. This mechanical percussion mechanism is associated with a drive body which is drivable by a drive motor of the handheld power tool and which is coupled to an operating mode switchover element which is used to switch over the percussion mechanism between a normal operation and a percussion operation. The operating mode switchover element includes a switchover shaft which is mounted in the inside of a hollow shaft forming the drive body. This switchover shaft is axially displaceable in the hollow shaft between a first and a second position by operating an actuating sleeve which is rotatably situated on the tool housing and associated with the operating mode switchover element; the first position is associated with normal operation and the second position is associated with the percussion operation of the percussion mechanism.

The disadvantage of the related art is that the handling of this handheld power tool is inconvenient and complicated since it is necessary to use both hands to switch over the handheld power tool between normal operation and the percussion operation; one hand is used to operate the actuating sleeve of the operating mode switchover element, while the other hand needs to hold the tool housing steady. The use of such a handheld power tool may result in comfort losses.

SUMMARY

An object of the present invention is therefore to provide a novel handheld power tool which has a mechanical percussion mechanism and may be operated single-handedly even when switching over between an associated normal operation and a percussion operation.

This object is achieved by a handheld power tool having a drive motor operable via a manual switch for driving a drive body which is associated with a mechanical percussion mechanism and coupled to a percussion member for driving an output shaft provided with a tool receptacle. The drive body is associated with an operating mode switchover element which is designed to switch over between a normal operation and a percussion operation of the percussion mechanism and which is coupled to the drive body. An operating device, which is coupled to the manual switch and which is designed to enable a switchover of the operating mode switchover element between normal operation and the percussion operation of the percussion mechanism by operating the manual switch, is provided for operating the operating mode switchover element.

The present invention thus makes it possible to provide a handheld power tool in which a single-handed switchover of the mechanical percussion mechanism is enabled between an associated normal operation and a percussion operation in a simple manner by operating the manual switch via the operating device due to the manual switch being coupled to the operating mode switchover element.

According to one specific embodiment, the operating mode switchover element is designed to block an axial displacement of the percussion member during normal operation of the percussion mechanism.

The provision of a safe and reliable operating mode switchover element may thus be made possible.

The drive body is preferably designed in the form of a sleeve having an interior in which the operating mode switchover element is mounted.

Thus, a simple and robust coupling of the operating mode switchover element to the drive body is made possible.

The operating mode switchover element is preferably designed in the form of a shaft which is axially displaceable in relation to the drive body.

The provision of a stable and cost-effective operating mode switchover element may thus be made possible.

According to one specific embodiment, the operating mode switchover element is acted on by an associated first spring element in a first axial operating position associated with the percussion operation of the percussion mechanism.

The present invention thus makes it possible to provide an operating mode switchover element which may be acted on safely and reliably by an uncomplicated and robust spring element in an axial operating position associated with the percussion operation of the percussion mechanism.

A second spring element, which is designed to act on the operating mode switchover element in a second axial operating position associated with normal operation of the percussion mechanism, is preferably associated with the operating device.

The present invention thus makes it possible to provide an operating mode switchover element which may be acted on safely and reliably by an uncomplicated and robust spring element in an axial operating position associated with the percussion operation of the percussion mechanism.

The first spring element preferably has a first spring force which is smaller than a second spring force associated with the second spring element.

It may thus be ensured in a simple manner that the axial operating position associated with normal operation of the percussion mechanism is a preferred operating position of the operating mode switchover element.

According to one specific embodiment, the operating device has a blocking element which is clamped by the second spring element in the axial direction against the operating mode switchover element in order to act on the operating mode switchover element in the second axial operating position associated with normal operation of the percussion mechanism.

The present invention thus makes it possible to provide a handheld power tool in which a spring force, applied by the second spring element to the operating mode switchover element, is transferable safely and reliably to the operating mode switchover element via the blocking element.

A support member associated with the operating device is preferably situated between the blocking element and the second spring element.

This makes it possible in a simple manner to couple the second spring element to the blocking element via an uncomplicated and cost-effective support member.

A gear which is drivable by the drive motor for driving the drive body is situated in the axial direction of the drive body preferably between the blocking element and the support member.

Thus, the operating device may be implemented in a tool housing associated with the handheld power tool in an at least comparably space-saving manner.

According to one specific embodiment, the operating device has a sliding element which is connected to the manual switch and designed to elastically deform the second spring element to release the operating mode switchover element in the case of an axial displacement causable by an operation of the manual switch.

The present invention thus allows the manual switch to be simply and reliably coupled to the second spring element via a stable and robust sliding element.

The present invention is described in greater detail in the following description with reference to the exemplary embodiments illustrated in the drawings.

DETAILED DESCRIPTION

Figure 1:
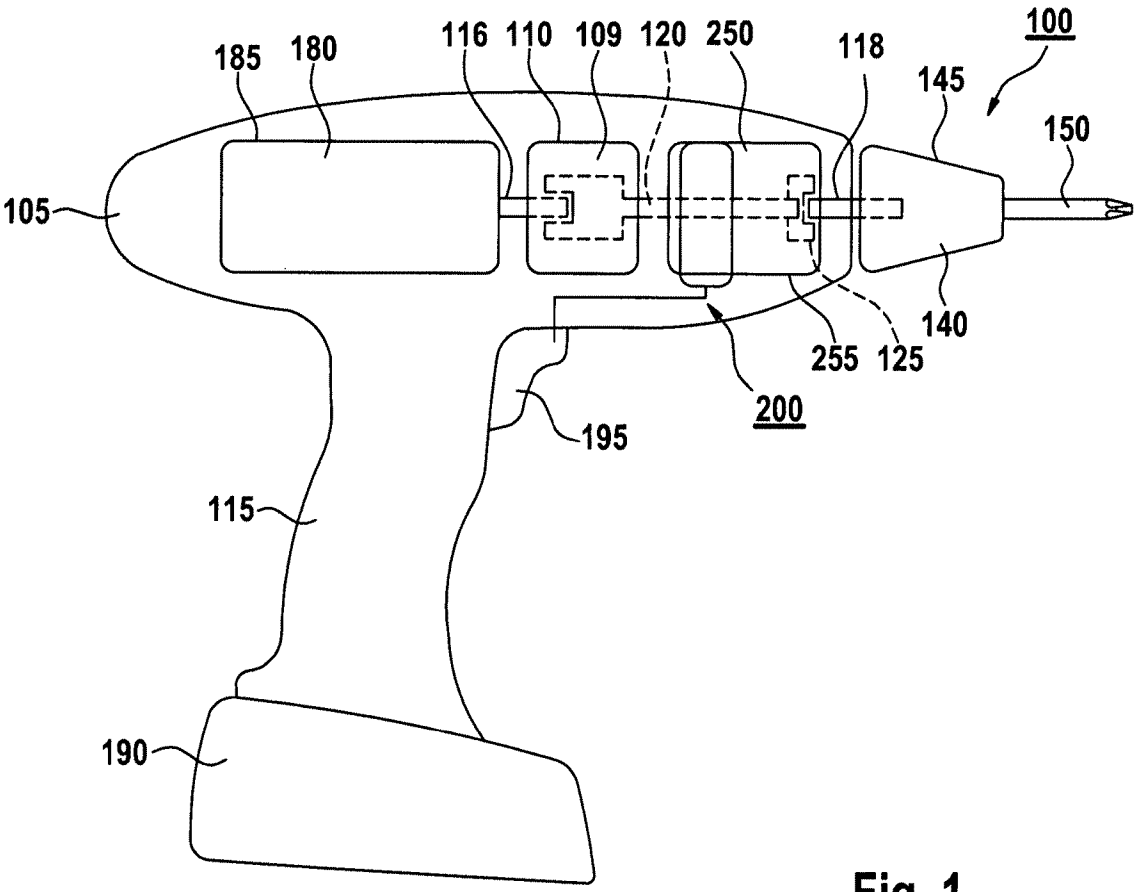
FIG. 1 shows a schematic view of a handheld power tool having a mechanical percussion mechanism according to one exemplary embodiment.

FIG. 1 shows a handheld power tool 100 provided with a tool receptacle 140 and a mechanical percussion mechanism 250 which has a tool housing 105 including a handle 115. According to one specific embodiment, handheld power tool 100 is connectable mechanically and electrically to a battery pack 190 for mains-independent power supply.

Handheld power tool 100 is designed as a cordless rotary percussion tool, as an example. It is, however, pointed out that the present invention is not limited to cordless rotary percussion tools, but may rather be used in various handheld power tools, in particular in power tools in which a tool is set into rotation, e.g., in the case of a percussion drill, etc., regardless of whether the power tool is mains-operated or operable mains-independently by using a battery pack. Moreover, it is pointed out that the present invention is not limited to motor-operated handheld power tools, but may be used in general in tools in which percussion mechanism 250 described in FIGS. 2 through 5 may be used.

An electric drive motor 180, which is supplied with power by battery pack 190, a gear 109, and percussion mechanism 250 are illustratively situated in housing 105. Drive motor 180 is used for driving a drive body 120 associated with percussion mechanism 250 and is, for example, operable via a manual switch 195, i.e., may be switched on and off, and may be any type of motor, e.g., an electronically commutated motor or a DC motor. The mode of operation and the design of a suitable drive motor are sufficiently known from the related art and are therefore not described here in greater detail for the sake of a concise description.

Drive motor 180 is connected via an associated motor shaft 116 to gear 109 which converts a rotation of motor shaft 116 into a rotation of drive body 120. This conversion preferably takes place in such a way that drive body 120 rotates in relation to motor shaft 116 at an increased torque but at a reduced rotational speed. Drive motor 180 is illustratively situated in a motor housing 185 and gear 109 is situated in a gear housing 110, gear housing 110 and motor housing 185 being situated in tool housing 105 as an example.

Mechanical percussion mechanism 250 connected to drive body 120 is a rotary percussion mechanism, as an example, which is situated in an illustrative percussion mechanism housing 255 and has a percussion member 125 which is in operative connection with drive body 120 and executes percussive angular momentums via associated drive cams (232 in FIG. 2) with great intensity and transfers them to an output shaft 118, e.g., an output spindle. It is, however, pointed out that the use of percussion mechanism housing 255 is an example only and does not pose any limitations to the present invention. It may in fact be used with percussion mechanisms without separate percussion mechanism housings which are situated directly in housing 105 of handheld power tool 100, for example. An exemplary design of percussion mechanism 250 is described in conjunction with a section of handheld power tool 100 shown in FIG. 2.

Tool receptacle 140, which is preferably designed to receive insert tools, is provided, as an example, on output shaft 118. Tool receptacle 140 illustratively has a so-called bit holder 145 which is connectable, as an example, to an insert tool 150, provided with an external polygonal coupling, e.g., a so-called screwdriver bit. Additionally or alternatively, tool receptacle 140 may also be connectable to an insert tool having an internal polygonal coupling, e.g., a so-called socket wrench, according to one specific embodiment. It is, however, pointed out that such bit holders and screwdriver bits or socket wrenches are sufficiently known from the related art so that a detailed description of these components is dispensed with for the sake of a concise description.

According to one specific embodiment, handheld power tool 100 has an operating device 200 which is coupled to manual switch 195 on the one side and to mechanical percussion mechanism 250 on the other side. This operating device 200 is preferably designed to allow mechanical percussion mechanism 250 to be switched over between an associated normal operation and a corresponding percussion operation by operating manual switch 195, as described below for FIGS. 2 through 5.

Figure 2:
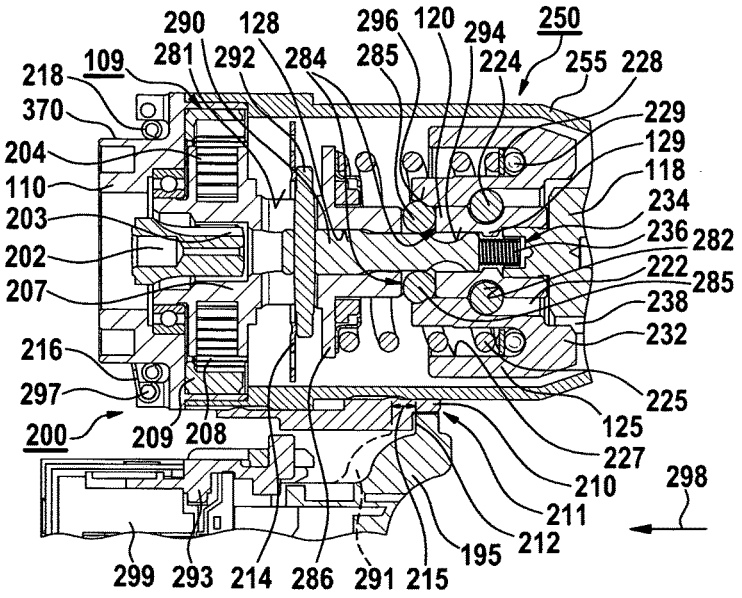
FIG. 2 shows a sectional view of a section of the handheld power tool from FIG. 1 during normal operation of the mechanical percussion mechanism.

FIG. 2 shows a section of handheld power tool 100 from FIG. 1, operable via manual switch 195 coupled to operating device 200, including gear 109 situated in gear housing 110 and mechanical percussion mechanism 250 from FIG. 1 being in operative connection with output shaft 118 and having percussion mechanism housing 255. Mechanical percussion mechanism 250 includes, as described in FIG. 1, percussion member 125 which is in operative connection with drive body 120 of gear 109 and which is situated in percussion mechanism housing 255 which is illustratively mounted on gear housing 110. Output shaft 118 has, as an example, at least one output cam 238 which is in operative connection with at least one drive cam 232 formed on percussion member 125.

According to one specific embodiment, a recess or indentation 234 is formed at an axial end area of output shaft 118, seen in the axial direction. This axial end area of output shaft 118 provided with recess 234 engages, as an example, with an axial end, which faces output shaft 118, of drive body 120 which is illustratively designed in the form of a sleeve or hollow shaft and thus has an interior 128, and is supported there, as an example, against an inner annular shoulder 129 formed in interior 128. At an axial end of drive body 120, which faces away from output shaft 118, a bearing part 207 is formed, which is rotatably mounted in gear housing 110 of gear 109, as an example.

Gear 109 is illustratively a reduction gear unit which is, for example, designed in the form of a planetary gear and has one or multiple planetary stages. Planetary gear 109 has, as an example, a single planetary stage having a sunwheel 203, planetary wheels 204, 208, an annulus gear 209, and a planetary carrier formed from bearing part 207 of drive body 120.

Sunwheel 203 is drivable by drive element 202 which is rotatably fixedly connected to motor shaft 116 from FIG. 1 or which may be integrally connected to it or may be designed in one piece with it. This drive element 202 and sunwheel 203 are preferably also designed in one piece. Since the design and the mode of operation of a planetary gear are sufficiently known to those skilled in the art, a further description of the planetary gear 109 is dispensed with for the sake of a concise description.

According to one specific embodiment, percussion member 125 is rotatably and axially displaceably situated at the outer periphery of drive body 120 designed in the form of a sleeve or hollow shaft. This percussion member is, for example, designed in the shape of a pot having a central opening provided for drive body 120 to be able to extend through, at least one drive cam 232 being situated in the area of the pot bottom, and an internal ring groove 296 and an external ring groove 227 being provided in the area facing away from the pot bottom. Internal ring groove 296 is used during normal operation of mechanical percussion mechanism 250 for receiving locking elements 285 which are designed in the form of locking balls and mounted in radial openings 284 provided on drive body 120.

Percussion member 125 is acted on by a spring element 225 in the direction of output shaft 118, the spring element being supported on the one side against an annular flange 286 provided on the outer periphery of drive body 120 and engages on the other side with ring groove 227. For this purpose, spring element 225 lies in ring groove 227 against a spacer ring 228, for example, which is rotatably mounted on a rolling bearing 229 provided in ring groove 227, in order to allow percussion member 125 to twist in relation to spring element 225.

Percussion member 125 is illustratively supported at the outer periphery of drive body 120 via at least one driving ball 224 designed as a steel ball, for example. For this purpose, at least one, for example, V-shaped, groove-like recess 282 is formed at the outer periphery of drive body 120 for guiding the at least one driving ball 224. At the inner periphery of percussion member 125, at least one indentation or recess 222 is formed for bearing the at least one driving ball 224. The driving ball is movable in V groove 282 and indentation or recess 222 during the percussion operation of mechanical percussion mechanism 250 in order to allow percussion member 125 to twist in relation to output shaft 118 and in relation to drive body 120.

According to one specific embodiment, a drive body 120 designed in the form of a sleeve or a hollow shaft is associated with an operating mode switchover element 290 provided for switching over between a normal operation and a percussion operation of mechanical percussion mechanism 250. This operating mode switchover element is designed to block an axial displacement of percussion member 125 during normal operation of percussion mechanism 250, as described below. Operating mode switchover element 290 is illustratively designed in the form of a shaft which is axially displaceably mounted in interior 128 of drive body 120 in relation thereto. For simplification of the description, shaft-like operating mode switchover element 290 is also referred to in the following as a "switchover shaft."

Figure 4:
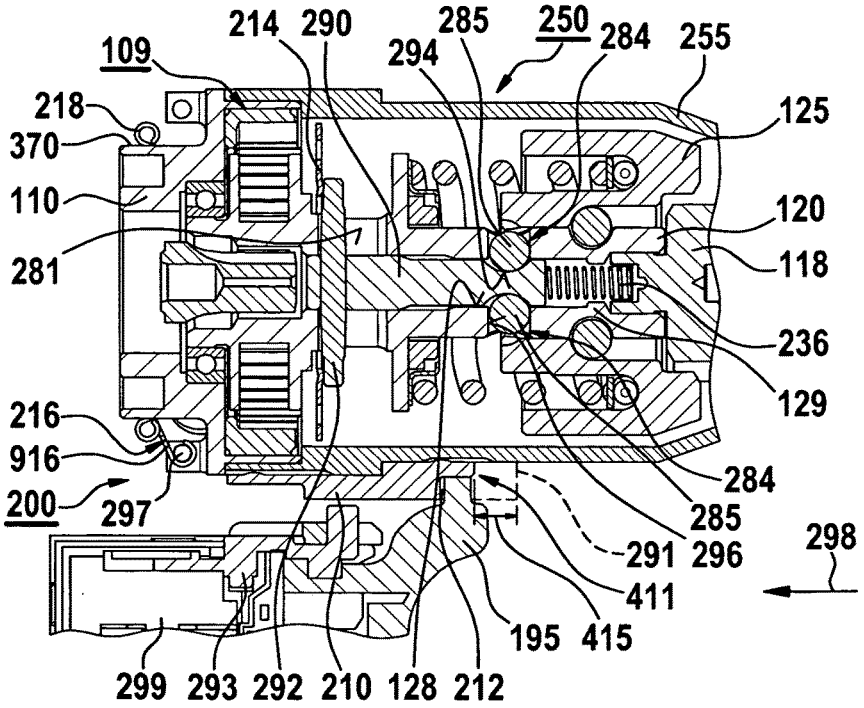
FIG. 4 shows a sectional view of a section of the handheld power tool from FIG. 1 during the percussion operation of the mechanical percussion mechanism.

Switchover shaft 290 has an external ring groove 294 at a first axial end area facing output shaft 118 and a bolt-like cross pin 292, which is illustratively mounted, e.g., pressed into, glued, and/or welded, in a pass-through opening illustratively provided for this purpose at switchover shaft 290 at an opposing, axial end area facing gear housing 110. This bolt-like cross pin 292 is thus an integral part of switchover shaft 290 and its axial ends are mounted, as an example, in a longitudinal recess 281 provided on drive body 120 and is displaceable therein transversely to its longitudinal extension in the axial direction of drive body 120 when switchover shaft 290 is axially displaced. The axial end area of switchover shaft 290 facing output shaft 118 is acted on in the direction of an arrow 298 by the spring force of a first spring element 236 which is designed as a pressure spring, for example, and which is illustratively situated in recess 234 of output shaft 118, and is referred to in the following as "pressure spring" for simplification of the description. For this purpose, pressure spring 236 is preferably designed to act on switchover shaft 290 in the direction of arrow 298 in an axial operating position associated with the percussion operation of percussion mechanism 250, as shown in FIG. 4.

According to one specific embodiment, switchover shaft 290 provided with bolt-like cross pin 292 is operable via operating device 200 which is coupled to manual switch 195 and which illustratively has a blocking element 214, a support member 218, a second spring element 216, and a sliding element 210. As an example, blocking element 214 is situated axially displaceably in and against the direction of arrow 298 in percussion mechanism housing 255 in the area between gear 109 and the axial ends of cross pin 292 and is designed to act on cross pin 292. For this purpose, blocking element 214 is designed, as an example, at least sectionally in the form of an annular disk, as described below for FIG. 8.

According to one specific embodiment, blocking element 214 has lateral operating arms (314 in FIG. 3) which are supported against support member 218 which is designed at least sectionally in the form of an annular disk. This support member is situated, seen in the direction of arrow 298, between blocking element 214 and second spring element 216 at outer periphery 370 of gear housing 110, gear 109 being situated, as an example, between blocking element 214 and support member 218.

Second spring element 216 is designed in the form of a fork having two spring arms (916 in FIG. 3), for example, and is also referred to in the following as "fork spring" for simplification of the description. This fork spring is illustratively fastened to a suspension 297 provided on gear housing 110. The spring arms (916 in FIG. 3) illustratively act on support member 218 against the direction of arrow 298 and thus clamp blocking element 214 against cross pin 292 in order to thus act on switchover shaft 290 against the direction of this arrow 298 in an axial operating position which is associated with normal operation of mechanical percussion mechanism 250 and is shown in FIG. 2. During this normal operation, locking balls 285 are pressed by switchover shaft 290 radially outward through openings 294 provided on drive body 120 against internal ring groove 296 of percussion member 125 so that an axial displacement of percussion member 125 in the direction of arrow 298 is blocked by locking balls 285. A spring force applied in the process by fork spring 216 is preferably greater than the spring force applied by pressure spring 236.

According to one specific embodiment, blocking element 214, support member 218, and fork spring 216 may be operatively connected to sliding element 210, which is designed in the form of a bowl, for example, as described below for FIGS. 4 and 5. This sliding element is mounted axially displaceably at the outer periphery of percussion mechanism housing 255, as an example, and has, at an axial end 211, a receptacle 212 for at least sectionally receiving manual switch 195 which is illustrated in a starting position and which is illustratively provided for activating or operating a so-called on-off switch 299. A resetting element 293 for automatically resetting manual switch 195 into the starting position is situated, as an example, between this on-off switch 299 and manual switch 195, when an appropriate user, for example, allows this manual switch to turn off handheld power tool 100 from FIG. 1.

Receptacle 212 is preferably designed in such a way that manual switch 195 is displaced with the aid of sliding element 210 into an operating position 291, indicated by a dashed line, for a displacement by a predefined distance 215 in the direction of arrow 298 against the spring force of fork spring 216, manual switch 195 activating on-off switch 299 to increase a particular associated motor speed during normal operation of mechanical percussion mechanism 250, without it being switched over to the percussion operation as a result of the displacement of sliding element 210. According to one specific embodiment, receptacle, 212 may also have a longitudinal extension of such a type that manual switch 195, which engages therewith, is displaceable by an initial predefined distance which causes an operation of on-off switch 299 to increase the motor speed during normal operation of mechanical percussion mechanism 250, but does not yet result in an operation or displacement of sliding element 210.

Figure 3:
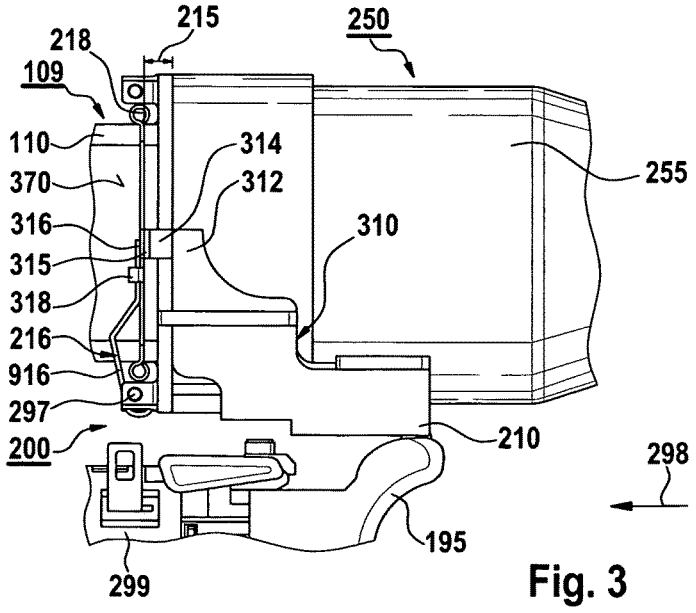
FIG. 3 shows a top view of a section of the handheld power tool from FIG. 1 illustrated in FIG. 2 during normal operation of the mechanical percussion mechanism.

FIG. 3 shows the system from FIG. 2 having percussion mechanism housing 255, which is fastened to gear housing 110 and on which bowl-like sliding element 210 is axially displaceably mounted, for the purpose of illustrating annular support member 218, mounted axially displaceably on gear housing 110, as well as fork spring 216 fastened to suspension 297 of gear housing 110. Sliding element 210 illustratively has a sliding bowl 310, which is displaceably mounted on percussion mechanism housing 255, as well as at least one sliding arm 312 integrally connected thereto which is formed at an axial end of sliding element 210 facing gear housing 110.

According to one specific embodiment, at least one holding element 318 is provided on support member 218 for slidingly holding an associated spring arm 916 of fork spring 216. Moreover, at least one retaining member 316, on which a bent end 315 of an operating arm 314 associated with blocking element 214 from FIG. 2 is supported, is illustratively provided, as an example, on support member 218.

By displacing manual switch 195 and thus sliding element 210 against the spring force of fork spring 216 in the direction of arrow 298 by predefined distance 215 from FIG. 2, sliding arm 312 of sliding element 210 is engaged or put into contact with bent end 315 of operating arm 314 of blocking element 214 from FIG. 2. By further displacing manual switch 195 and thus sliding element 210 in the direction of arrow 298, an axial displacement of blocking element 214 from FIG. 2 and of support member 218, as well as an elastic deformation of spring arm 916 of fork spring 216 in order to switch over mechanical percussion mechanism 250 from normal operation to percussion operation may be brought about, as described below for FIGS. 4 and 5.

FIG. 4 shows the system from FIGS. 2 and 3 in which manual switch 195 has been displaced starting from operating position 291 shown in FIG. 2 against the spring force of fork spring 216 by a predefined distance 415 further in the direction of arrow 298 into an operating position 411. This displacement is transferred via sliding arm 312 of sliding element 210 to bent end 315 of operating arm 314 of blocking element 214 and thus to support member 218 and fork spring 216. In this way, blocking element 214 and support member 218 are also displaced by a predefined distance 415 starting from their positions shown in FIG. 2 against the spring force of fork spring 216 in the direction of arrow 298, its spring arm 916 being elastically deformed.

Due to the axial displacement of blocking element 214 forced thereby, cross pin 292 and thus switchover shaft 290 are released. This switchover shaft is axially displaced by the spring force of pressure spring 236 in the direction of arrow 298 into its axial operating position associated with the percussion operation of percussion mechanism 250 during which the locking balls 285 engage radially inward with ring groove 294 provided on switchover shaft 290 and thus release percussion member 125.

It is, however, pointed out that the mode of operation of mechanical percussion mechanism 250 during normal operation and the percussion operation is sufficiently described, per se, to those skilled in the art, e.g., in International Patent Publication No. WO 2008/101556, so that a detailed description thereof may be dispensed with for the sake of a concise description. Therefore, the disclosure of International Patent Publication No. WO 2008/101556 is explicitly included in the disclosure of the present invention.

Figure 5:
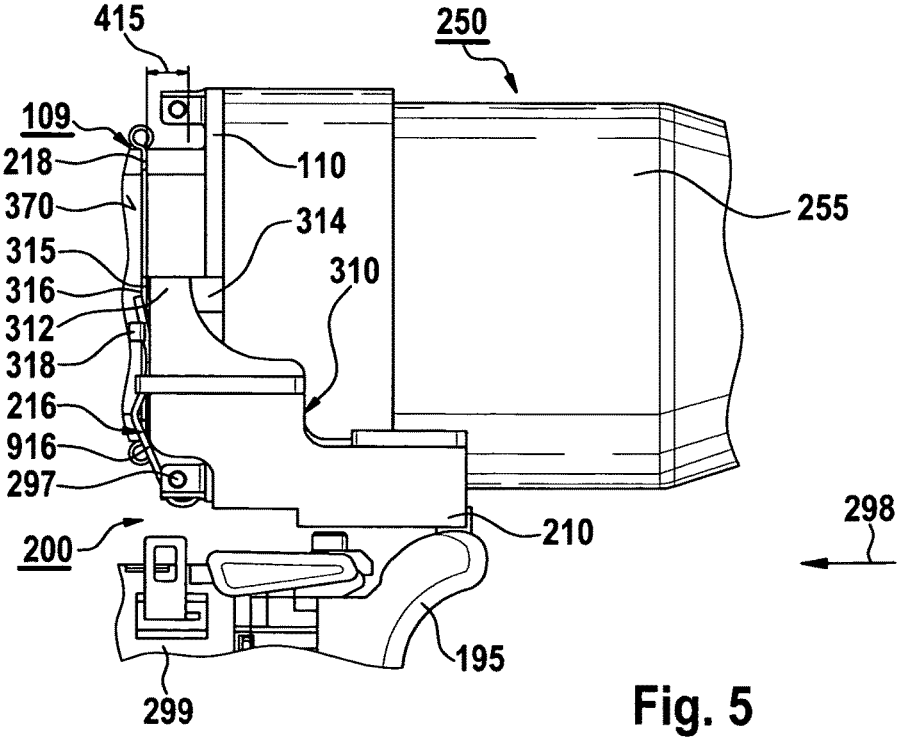
FIG. 5 shows a top view of a section of the handheld power tool from FIG. 1 illustrated in FIG. 4 during the percussion operation of the mechanical percussion mechanism.

FIG. 5 shows the system from FIG. 4 for the purpose of illustrating the operation or the axial displacement of support member 218 as well as operating arm 314, and thus blocking element 214 via sliding element 210 upon operation of manual switch 195. Moreover, FIG. 5 illustrates the elastic deformation of spring arm 916 of fork spring 216 forced thereby.

Figure 6:
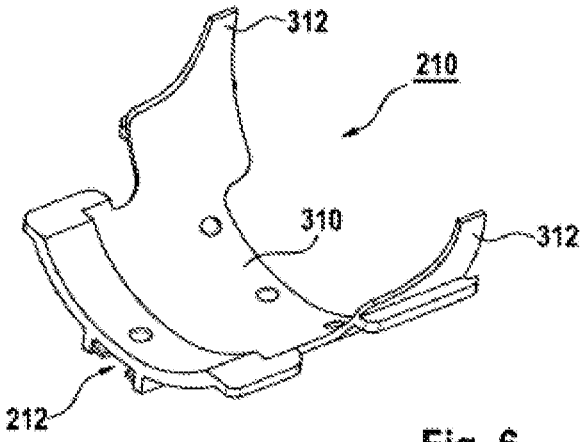
FIG. 6 shows a perspective view of the sliding element from FIGS. 2 through 5 according to one exemplary embodiment.

FIG. 6 shows an exemplary embodiment of sliding element 210 from FIGS. 2 through 5 having sliding bowl 310 on which receptacle 212 as well as two exemplary sliding arms 312 are illustratively formed.

Figure 7:
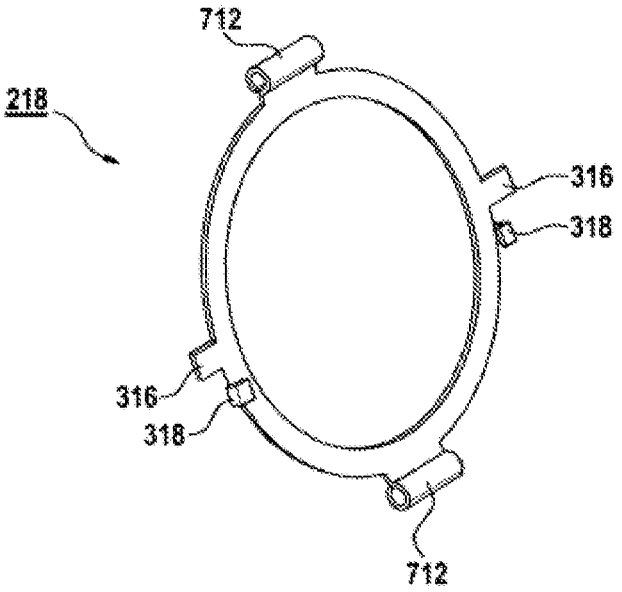
FIG. 7 shows a perspective view of the support member from FIGS. 2 through 5 according to one exemplary embodiment.

FIG. 7 shows an exemplary embodiment of annular support member 218 from FIGS. 2 through 5 on which two lateral holding elements 318 as well as two lateral retaining members 316 are illustratively formed. Moreover, support member 218 has two annular stiffening members 712.

Figure 8:
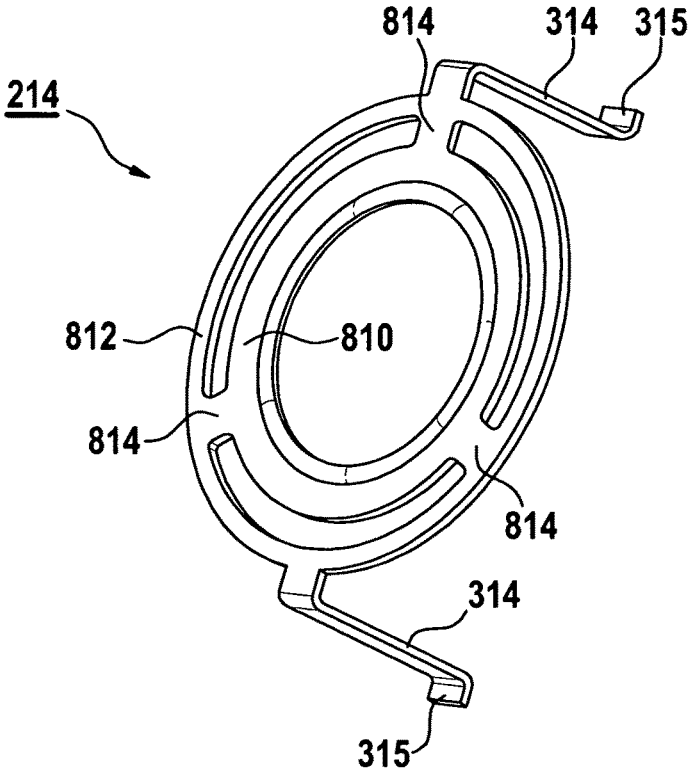
FIG. 8 shows a perspective view of the blocking element from FIGS. 2 and 4 according to one exemplary embodiment.

FIG. 8 shows an exemplary embodiment of blocking element 214 from FIGS. 2 and 4 which illustratively has two lateral operating arms 314 having bent ends 315. Moreover, blocking element 214 illustratively has an inner support ring 810 against which cross pin 292 from FIGS. 2 and 4 is supported, for example, as well as an outer stiffening ring 812 which is connected to inner support ring 810 via stiffening cross struts 814, as an example.

Figure 9:
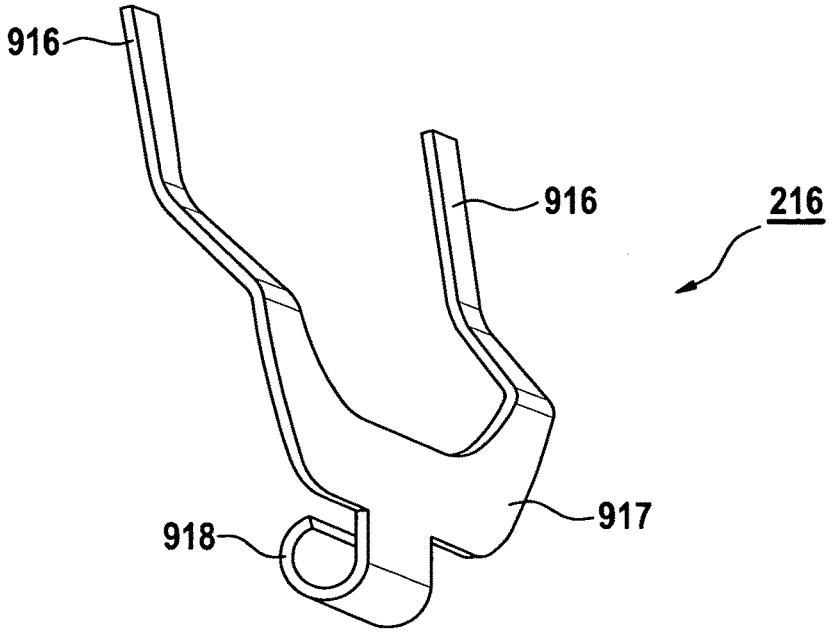
FIG. 9 shows a perspective view of the second spring element from FIGS. 2 through 5 according to one exemplary embodiment.

FIG. 9 shows an exemplary embodiment of fork spring 216 from FIGS. 2 through 5 which illustratively has a U shape and two elastically deformable spring arms 916 which are, for example, connected to one another via a connector 917. An annular suspension element 918 for suspending at suspension 297 from FIGS. 2 through 5 is formed on the connector as an example.

What is claimed is:

1. A handheld power tool, comprising:

a drive motor operable via a manual switch for driving a drive body which is associated with a mechanical percussion mechanism and coupled to a percussion member for driving an output shaft provided with a tool receptacle, an operating mode switchover element which is configured to switch over between a normal operation and a percussion operation of the percussion mechanism and which is coupled to the drive body being associated with the percussion mechanism, wherein an operating device, which is coupled to the manual switch and which is coupled to the operating mode switchover element is configured for operating the operating mode switchover element to switchover the operating mode switchover element between the normal operation and the percussion operation of the percussion mechanism by operating the manual switch, wherein the operating device includes a blocking element, a support member, and a spring element, wherein, upon displacement of the manual switch in the axial direction of the handheld power tool up to a predefined distance, the drive motor is operated and the handheld power tool is operated in the normal operation of the percussion mechanism wherein, upon displacement of the manual switch in the axial direction of the handheld power tool beyond the predefined distance, and upon axial displacement of the blocking element and of the support member, and upon elastic deformation of the spring element, the drive motor is operated and the handheld power tool is operated in the percussion operation of the percussion mechanism.

2. The handheld power tool according to claim 1, wherein the operating mode switchover element is designed to block an axial displacement of the percussion member during the normal operation of the percussion mechanism.

3. The handheld power tool according to claim 1, wherein the drive body is configured in a form of a sleeve having an interior in which the operating mode switchover element is mounted.

4. The handheld power tool according to claim 1, wherein the operating mode switchover element is configured in a form of a shaft which is axially displaceable in relation to the drive body.

5. The handheld power tool according to claim 1, wherein the operating mode switchover element is acted on by an associated first spring element in a first axial operating position associated with the percussion operation of the percussion mechanism.

6. The handheld power tool according to claim 5, wherein the operating device is associated with the spring element which is configured to act on the operating mode switchover element in a second axial operating position associated with the normal operation of the percussion mechanism.

7. The handheld power tool according to claim 6, wherein the first spring element has a first spring force which is smaller than a second spring force associated with the spring element.

8. The handheld power tool according to claim 6, wherein the blocking element is clamped by the spring element in an axial direction against the operating mode switchover element in order to act on the operating mode switchover element in the second axial operating position associated with the normal operation of the percussion mechanism.

9. The handheld power tool according to claim 8, wherein the support member is situated between the blocking element and the spring element.

10. The handheld power tool according to claim 9, wherein a gear which is drivable by the drive motor for driving the drive body is situated in the axial direction of the drive body between the blocking element and the support member.

11. A handheld power tool, comprising:

a drive motor operable via a manual switch for driving a drive body which is associated with a mechanical percussion mechanism and coupled to a percussion member for driving an output shaft provided with a tool receptacle, an operating mode switchover element which is configured to switch over between a normal operation and a percussion operation of the percussion mechanism and which is coupled to the drive body being associated with the percussion mechanism, wherein an operating device, which is coupled to the manual switch and which is configured to enable a switchover of the operating mode switchover element between the normal operation and the percussion operation of the percussion mechanism by operating the manual switch, is provided for operating the operating mode switchover element, wherein the operating mode switchover element is acted on by an associated first spring element in a first axial operating position associated with the percussion operation of the percussion mechanism, wherein the operating device is associated with a second spring element which is configured to act on the operating mode switchover element in a second axial operating position associated with the normal operation of the percussion mechanism, wherein the operating device has a sliding element which is connected to the manual switch and is configured to elastically deform the second spring element to release the operating mode switchover element in a case of an axial displacement causable by an operation of the manual switch.

12. A handheld power tool, comprising:

a drive motor operable via a manual switch for driving a drive body which is associated with a mechanical percussion mechanism and coupled to a percussion member for driving an output shaft provided with a tool receptacle, an operating mode switchover element which is configured to switch over between a normal operation and a percussion operation of the percussion mechanism and which is coupled to the drive body being associated with the percussion mechanism, wherein an operating device, which is coupled to the manual switch and which is configured to enable a switchover of the operating mode switchover element between the normal operation and the percussion operation of the percussion mechanism by operating the manual switch, is provided for operating the operating mode switchover element, wherein the drive body is configured in a form of a sleeve having an interior in which the operating mode switchover element is mounted.

13. A handheld power tool, comprising:

a drive motor operable via a manual switch for driving a drive body which is associated with a mechanical percussion mechanism and coupled to a percussion member for driving an output shaft provided with a tool receptacle, an operating mode switchover element which is configured to switch over between a normal operation and a percussion operation of the percussion mechanism and which is coupled to the drive body being associated with the percussion mechanism, wherein an operating device, which is coupled to the manual switch and which is coupled to the operating mode switchover element is configured for operating the operating mode switchover element to switchover the operating mode switchover element between the normal operation and the percussion operation of the percussion mechanism by operating the manual switch, wherein the drive body is configured in a form of a sleeve having an interior in which the operating mode switchover element is mounted.

* * * * *